US008039100B2

(12) United States Patent
Cucitore et al.

(10) Patent No.: US 8,039,100 B2
(45) Date of Patent: Oct. 18, 2011

(54) HIGH DURABILITY PHOTOCATALYTIC PAVING FOR REDUCING URBAN POLLUTING AGENTS

(75) Inventors: Roberto Cucitore, Redona (IT); Stefano Cangiano, Torre de Roveri (IT); Luigi Cassar, San Donato Milanese (IT)

(73) Assignee: ITALCEMENTI S.p.A., Bergamo (IT)

( * ) Notice: Subject to any disclaimer, the term of this patent is extended or adjusted under 35 U.S.C. 154(b) by 372 days.

(21) Appl. No.: 11/629,755

(22) PCT Filed: Jun. 22, 2005

(86) PCT No.: PCT/EP2005/052923

§ 371 (c)(1),
(2), (4) Date: Dec. 14, 2006

(87) PCT Pub. No.: WO2006/000565

PCT Pub. Date: Jan. 5, 2006

(65) Prior Publication Data

US 2007/0207302 A1 Sep. 6, 2007

(30) Foreign Application Priority Data

Jun. 23, 2004 (IT) ..... MI2004A1261

(51) Int. Cl.
*B32B 5/24* (2006.01)

(52) U.S. Cl. ..... 428/323; 404/31; 404/70

(58) Field of Classification Search ..... 428/323; 404/31, 70

See application file for complete search history.

(56) References Cited

U.S. PATENT DOCUMENTS

| | | | | |
|---|---|---|---|---|
| 3,385,181 | A * | 5/1968 | Stoll | 404/70 |
| 4,392,335 | A * | 7/1983 | Heiman | 52/309.17 |
| 5,628,822 | A * | 5/1997 | Hogan | 106/802 |
| 6,454,489 | B1 * | 9/2002 | Murata et al. | 404/17 |
| 6,632,309 | B1 * | 10/2003 | Hendrix et al. | 156/148 |

FOREIGN PATENT DOCUMENTS

| | | |
|---|---|---|
| EP | 0 505 010 A1 | 9/1992 |
| EP | 0 919 667 A1 | 6/1999 |
| EP | 1 020 564 A1 | 7/2000 |
| JP | 2003/096707 | 4/2003 |

* cited by examiner

*Primary Examiner* — Callie Shosho
*Assistant Examiner* — Elizabeth Robinson
(74) *Attorney, Agent, or Firm* — Abelman, Frayne & Schwab

(57) ABSTRACT

The present invention concerns a composite cement paving with photocatalytic action for reducing urban polluting agents, composed of a bituminous or cement foundation, a resin having the function of interface, a superficial cement layer with photocatalytic properties able to reduce organic and inorganic polluting agents, said paving also comprising reinforcing materials and possible suitably positioned fibrous materials. The paving thus realised presents a strong photocatalytic action, prolonged overtime, even in the presence of high mechanical stress caused by heavy traffic.

18 Claims, 4 Drawing Sheets

HIGH DURABILITY PHOTOCATALYTIC PAVING FOR REDUCING URBAN POLLUTING AGENTS

FIELD OF THE INVENTION

The present invention concerns the field of photocatalytic cement materials and their applications for reducing urban pollution. New paving structures are described which contain photocatalytic substances having high resistance to surface erosion, with a strong pollution reducing activity prolonged over time.

PRIOR ART

Atmospheric pollution is caused by the presence in the air of one or more undesirable or extraneous substances in such quantities or for such a duration as to alter the healthiness of the air and to form a danger for human health. If one considers that quantity of air breathed in every day by an individual (in conditions of rest, from 6 to 98 liters of air per minute, that is about 9.13 cubic meters per day), one can realise its importance for health and the risks connected with breathing polluted air.

Generally the main sources of pollution are emissions in the atmosphere due to production processes (industrial and handicraft activities) and to combustion processes (heating and vehicle traffic). The main source of pollution is vehicle traffic. The latter is responsible for the emission in the atmosphere of the products of engine combustions, the powders produced by the wear of brakes, tyres and road surfaces, and lastly by the hydrocarbons vaporised from vehicle fuel tanks. Motor vehicle exhausts, deriving from incomplete fuel combustion, comprise numerous substances in the form of gas and powders. The main one of these are: carbon monoxide (CO); nitrogen oxides ($NO_x$); sulphur oxides ($SO_x$); volatile organic compounds (VOC); suspended total particles (TSP) which contain numerous pollutants: lead, cadmium, aromatic polycyclic hydrocarbons, to mention only the most significant. The large contribution of vehicle traffic to the emissions in the atmosphere is also demonstrated by the fact that pollution in urban areas is no longer limited to the winter period but has become, with more or less acute episodes, a constant feature of the whole year. The atmospheric pollutants listed above perform an irritating action on the mucosa, particularly on those of the airways.

Various solutions have been proposed to overcome these problems; one of the most interesting concerns the use of cement materials containing photocatalysts which, when applied on the outside walls of buildings, are able to oxidise the polluting substances present in the environment which come in contact with the surfaces of said structures. The patent application WO 98/05601 concerns cement materials comprising particles of $TiO_2$ prevalently in the form of anatase, able to photo-oxidise the polluting substances present in the environment so as to preserve the constancy of colour of the materials for a longer time once in place. The application WO 01/00541 concerns the use of specific additives for obtaining paint with a cement base with photocatalytic properties. The patent EP 919667 describes a paving which, thanks to the use of photocatalysis, is able to reduce considerably the percentage of $NO_x$ present in the environment; the structure of the paving described comprises at least two layers: a foundation layer composed of asphalt or concrete and a surface layer between 1 and 300 mm thick with a cement base which comprises the photocatalyst.

Photocatalytic layers with an intermediate thickness (about 5-50 mm) are particularly interesting: in fact the photocatalytic layer is sufficiently thick to resist surface abrasion; at the same time it is still thin enough to be able to set rapidly immediately after being laid in the fluid state: this is a particularly important aspect, as photocatalytic pavings are often made on existing roads subject to heavy traffic: these roads must be closed to the public for the shortest time possible. Unfortunately, in this range of thickness a structurally critical configuration is created linked with the different degree of deformability of the asphalt foundation and of the photocatalytic cement surface layer; the latter is not able to ensure a bearing function of the whole paving; so, when the road surface is subject to a heavy load, the plastic deforming movement of the bituminous layer prevails; at the same time, the high rigidity of the photocatalytic layer is such as to prevent it from adapting elastically to the deformations of the asphalt; so, after repeated load cycles, the lower bituminous layer is deformed and the upper photocatalytic layer, unable to follow the deformation of the foundation, tends to crack; the cracked layer is then rapidly crumbled and eroded by atmospheric agents and by the movement of vehicles: consequently the photocatalytic activity of the paving is lost quickly after installation; moreover the erosion of the surface layer threatens the integrity of the road surface, with the result that the road must be repaired frequently.

It is therefore important to have pavings with a photocatalytic layer with an intermediate thickness, able to ensure a high mechanical strength and prolonged photocatalytic activity over time, even when subjected to intense mechanical stress by vehicle traffic. All these objectives are all the more urgent if one considers the fact that the road paving is applied to extremely large surfaces: therefore every improvement in the sense indicated above is of fundamental importance from the point of view of the industrial utility and commercial competitiveness of the product.

SUMMARY

The Applicant has now surprisingly found that the known disadvantages of the art may be overcome by means of a composite paving comprising at least the following three layers, applied from bottom to top:

(i) a foundation layer (ii) an intermediate layer comprising a resin and a reinforcing material (iii) a surface layer comprising a photocatalytic cement composition.

The foundation layer (i), is an ordinary structure of urban or extra-urban paving. The intermediate layer (ii) is composed of resins such as, for example, epoxy or polyurethane resins. The reinforcing material may be an actual mesh, a set of filaments or fibres of suitable length which, when laid on the foundation layer, form a mesh for overlaying. The surface layer (iii) contains the photocatalyst, preferably titanium dioxide, a hydraulic binder, aggregates, any cement additives and anti-shrinkage fibres.

The paving is produced by adding, to a foundation layer, the reinforcing material, the resin, and a cement composition in the fresh state comprising the photocatalyst, a hydraulic binder, aggregates, any cement additives and anti-shrinkage fibres.

After a suitable setting time of the surface and of the resin below, the paving is ready to be opened to pedestrian and/or vehicle traffic.

This paving presents a strong and long-lasting photocatalytic action, even in the presence of high mechanical stress from heavy traffic.

DETAILED DESCRIPTION OF THE INVENTION

Figure 1:
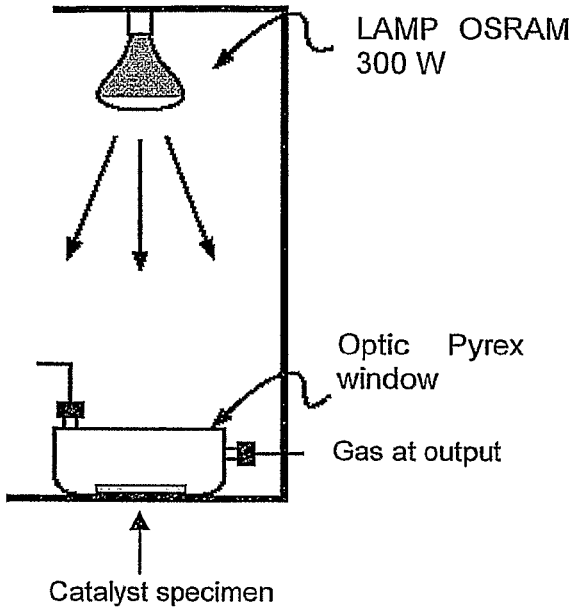
FIG. 1: Graphic representation of the experimental details of the reaction chamber (1.5 L or 3.5 L) containing the sample of photocatalyst, or catalyst sample, said chamber having a Pyrex optical window, as described in Example 3.

The foundation layer (i) does not have different requirements from those of ordinary urban or extra-urban pavings; it may therefore be an ordinary road or pedestrian paving (for example road, motorway, hardstand, parking area, garage, access ramp, pavement, pedestrian area, etc.); it may be a pre-existing layer or it may be created on purpose; it may have a continuous and uniform morphology such as that of a layer of asphalt or concrete or a discontinuous and non uniform morphology such as that of paving blocks. As may be seen below, in the present invention, any deformation under load of the foundation layer is not detrimental to the performance of the top photocatalytic layer and its lasting activity.

The layer (ii) comprises a resin and a reinforcing material.

The resin (or primer) is preferably chosen among epoxy and polyurethane resins; they are typically two-component resins, preferably with low viscosity, which facilitates their spreading, for example using spray systems. Typically the resin to be used according to the invention presents a viscosity between 200 and 1200 mPa per sec., more preferably between 500 and 900 mPa per sec., and even more preferably equal to about 720 mPa per sec., assessed according to standard ISO 9371, at 25° C. The modulus of elasticity (calculated when the resin is hardened) is preferably between 3000 and 3500 MPa at room temperature. The tensile strength of the hardened resin after 7 days is preferably between 40 and 80 MPa, more preferably equal to about 60 MPa. Examples of such products are epoxy resins of the Fast type (Tecnoresyn, Bakelite).

A further component of the layer (ii) is a reinforcing material, for example composed of metal wires even in the form of a mesh.

The reinforcing material may be a real mesh, for example a metal mesh of stainless or galvanised steel; as an example without limitation, reference may be made to meshes with links having an opening between 10 and 50 mm, preferably between 20 and 30 mm, and with wire diameter between 0.5 and 2 mm, preferably between 0.8 and 1.2 mm. Alternatively the reinforcing material may be a set of filaments of suitable length (for example between 1 and 20 meters) and diameter as indicated above which, when laid on the foundation layer, form a mesh by simple superimposition; in this case the interaction is ensured by their connection with the resin and with the photocatalytic layer on top.

The reinforcing material may alternatively be composed of independent fibres, for example stainless or galvanised steel. As an example without limitation, the diameter of the fibres is between 0.5 and 1 mm, preferably between 0.2 and 0.5 mm; their length is generally between 10 and 50 mm, for example 30·cm.

The surface layer (iii) comprises a photocatalyst, that is a substance which in the presence of light and air is able to catalyse a decomposition reaction of one or more pollutants present in the environment, whether they be of inorganic or organic nature; examples of these pollutants are aromatic polycondensates, aldehydes, carbon black which may be assimilated to PM10, nitrogen oxides ($NO_x$) and sulphur oxides ($SO_x$).

A preferred example of a photocatalyst is titanium dioxide, which is preferably used, prevalently or totally, in the form of anatase.

In a particularly preferred aspect of the invention the particles of photocatalyst are particles of 100% titanium anatase, with nanometric dimensions, such as to present a specific surface between 5 and 350 $m^2$/gr, more preferably between 100 and 300 $m^2$/gr. In a preferred aspect of the invention, $TiO_2$ PC 105 by Millennium Inorganic Chemical was used.

The quantity of photocatalyst present in the photocatalytic cement composition is not critical, though it is desirable to use low quantities for cost reasons.

Preferably, the cement composition according to the present invention contains from 0.1% to 20% by weight with respect to the total of the components of layer (iii) in the dry state, more particularly from 0.3% to 3%, for example around 1.5% of photocatalyst.

In the present text, the term "binder" or "hydraulic binder" means a pulverised material in the solid, dry state which, when mixed with water, supplies plastic mixtures that are able to set and harden, even under water, for example a cement. The term "cement composition" (or "cement mix" or "mix") means a composition in which a binder is mixed with water and aggregates of various granule size. The "aggregates" (or "inert materials" or "inert aggregates", all synonyms according to the present invention), may be fine aggregates, such as sand and filler, and classified according to standard UNI EN 206.

Examples of mixes are mortars (mixtures comprising binder, water and fine aggregate), and concretes (mixtures comprising water, binder, fine aggregate and coarse aggregate).

The "clinker" used to prepare a binder for the present invention is any clinker of Portland cement thus defined according to standard UNI EN 197.1 and that is a hydraulic material composed of at least two thirds of the mass of calcium silicates ($3CaO\ SiO_2$) and ($2CaO\ SiO_2$), the remaining part being $Al_2O_3$, $Fe_2O_3$ and other oxides.

The definition of "hydraulic binder" according to the present invention includes both cements (white, grey or pigmented) defined according to the already mentioned standard UNI EN 197.1 and the so-called cements for dikes, cement binders and hydraulic lime as defined in Italian Law no. 595 of 26 May 1965 and inorganic silicates.

In the present text the term "in mass" indicates the photocatalyst is added to the mass of the binder, or of the cement compositions according to the present invention, and is therefore distributed in the entire mass, that is also in the internal and deep layers, and not only on the surface of the present premix, and therefore of the cement compositions obtained from them. In a preferred aspect of the invention the photocatalytic cement TX Millennium is used, which is marketed by the Applicant and comprises the hydraulic binder and titanium dioxide useful for decomposing urban pollutants.

In the photocatalytic cement composition of the surface layer (iii) there may be accelerating additives, setting regulators, fluidifying agents, super fluidifying agents, and other typical additives of mortars and concretes. The use of setting and hardening accelerants is particularly appreciated as it allows to reduce the surface setting time, and therefore the time in which the treated surface is not open to traffic. The typical accelerants known in the art may be used, for example $CaCl_2$ or $Ca(NO_3)_2$; the accelerant dosing depends on the environment temperature, as is known in the cement sector; for example at 20° C. on average between 0.5% and 3% by weight is used, calculated with respect to the cement. Among the optional components of the surface layer, a fibrous material must be mentioned, this term meaning independent fibres of various length distributed in the mass of the layer (iii). Irrespective of its reinforcing function, this material is useful for combating the phenomenon of shrinkage. Preferably, fibres with a low modulus of elasticity may be used, for example polypropylene with length from 3 mm to 25 mm, preferably between 4 and 10 mm, in quantities from 0.5 to 10 $kg/m^3$ with respect to the cement mortar in the fresh state.

The thickness of the layer (iii), once set, is preferably comprised between 5 mm and 50 mm, more preferably between 10 mm and 30 mm, even more preferably between 12 mm and 20 mm.

The process of preparing the paving described above is a further object of the invention. This process comprises the following passages:

(a) applying a resin and a reinforcing material on a foundation layer.

(b) applying on the resulting layer a fresh cement composition comprising a photocatalyst.

The foundation layer may be a pre-existing layer or it may be created on purpose. In the case of pre-existing foundations, it is advisable to carry out a suitable cleaning/washing operation to eliminate dust, oils or other extraneous material present on the surface; it is also possible to carry out milling (scarification) of the surface, according to methods and with equipment commonly used in the field of road maintenance: this contributes to flatten surfaces deformed due to the presence of localised sinking. These operations are useful but not indispensable for obtaining the results of the invention.

If the foundation is created on purpose, it is made according to the techniques commonly used, depending on whether it is an asphalt road, a pavement, block paving, a cement surface, etc.

In passage (a), a layer of resin and a reinforcing material are applied on said foundation. These two elements may be laid in any order however, considering the limited time for the resin to set, it is preferably to lay first the reinforcing material and then the resin. In laying the reinforcing material, it is possible to insert spacers between the mesh and the foundation, for example plastic spacers, so that the mesh is fixed in position at a slight distance (for example 3-4 mm) from the foundation; the reinforcing material may also be anchored to the edges of the area concerned using a nail gun or similar means, to the advantage of further solidity of the structure as a whole.

The resin is laid according to means known in the sector, preferably by spraying with suitable lances or spray pumps; for example, depending on the foundation to be treated, it may be used in quantities between 50 and 600 $gr/m^2$, preferably between 100 and 300 $gr/m^2$.

In phase (b), on the foundation thus prepared, the photocatalytic cement layer, which may preferably have thixotropic characteristics, is laid. This is made beforehand from dry or premixed mixtures containing the components described above in point (iii), made fluid or thixotropic and homogeneous by mixing with suitable quantities of water. When the fibrous material is present, it is preferably already included in the dry premixes, however the possibility of adding it separately to fresh cement mixes that do not contain it is not excluded. The mixes in the fresh state resulting from mixing with water are typically mortars, comprising water and the above-mentioned photocatalyst, hydraulic binder, aggregates such as, for example, sand, cement additives. The water/binder ratios are those currently used for preparing mortars or similar fresh cement mixes, and are generally between 0.3 and 0.45. The quantity of hydraulic binder with respect to the total dry mixture may vary between 30 and 45% in weight. The mixture thus prepared is applied in the fresh state on the foundation already covered with the reinforcing material and with the resin still not hardened; considering the rapid setting time of the resin, it is advisable that the fresh cement composition be prepared separately before activating the resin, and kept as such, ready for casting, until it is time to lay it. The layer (iii) is applied according to techniques and with machinery currently in use, for example machines for automatic spreading possibly equipped with laser control, systems for manual spreading, for example vibrating sieves, etc. Spreading may be completed by preparing joints, according to the techniques currently in use, for example with metal blades with a triangular section, and with a final operation of surface finishing, also per se known.

After a suitable setting time of the surface and of the resin below, the paving is ready to be opened to pedestrian and/or vehicle traffic.

The paving structures realised according to the invention are able to reduce the organic and inorganic pollutants present in the environment, such as aromatic polycondensates, aldehydes, carbon black which may be assimilated to PM10, nitrogen oxides ($NO_x$) and sulphur oxides ($SO_x$). When titanium dioxide is used as a photocatalyst, the effect is particularly intense with respect to $NO_x$.

A further object of the invention is therefore the use of a paving as described above to reduce the organic and inorganic pollutants present in the environment, The invention described above has allowed the realisation of pavings with photocatalytic surface layers with an intermediate thickness, typically between 5 and 50 mm, preferably between 10 and 30 mm, more preferably between 12 and 20 mm, thick enough to resist phenomena of surface abrasion, though avoiding all excess of photocatalyst linked to the formation of layers that are too thick. At the same time, the photocatalytic layer presents a high consistence and hardness in the presence of heavy mechanical stress thanks to its high homogenisation with the layers below. In this situation, any deformation of the foundation layer under load does not in any way detract from the adhesiveness and coherence of the photocatalytic layer. Therefore, even in conditions of consistent traffic of heavy vehicles, the paving maintains lasting high consistency and a homogeneous surface and high photocatalytic activity.

The invention is now described with reference to the following examples without limitation.

EXPERIMENTAL PART

Example 1

A rapid photocatalytic cement mortar was prepared for the surface layer of the composite paving according to the following formula:

| Mixture A | |
|---|---|
| | % of the total |
| Cement TX (Millenium) | 36.08 |
| Quartz aggregates | 47.83 |
| $CaCl_2 \times 2H_2O$ | 0.74 |
| Superflux NF (liq.) | 0.73 |
| Acrylic HSP 146 (liq) | 0.21 |
| Polypropylene fibres | 0.05 |
| Added water | 14.37 |
| Total | 100 |
| Total water | 15.2 |

The water/cement ratio is 0.42; the polypropylene fibres have a low modulus of elasticity. An accelerating additive has been added to this mixture. The mortar was prepared in a forced mixer, first putting all the solid material into the bowl of the mixture and then, after starting rotating the mixture, the additives and the water. The fibres were added to the dry material.

Example 2

A second photocatalytic cement mortar was prepared for the surface layer of the composite paving according to the following formula:

| Mixture B | |
|---|---|
| | % of the total |
| Cements TX (Millenium) | 30.97 |
| Quartz aggregates | 57.52 |
| Superflux NF (liq.) | 0.63 |
| Acrylic HSP 146 (liq) | 0.19 |
| PP fibres | 0.05 |
| Added water | 10.64 |
| Total | 100 |
| Total water | 15.2 |

The water/cement ratio is 0.36.

Example 3

The $NO_x$ and $NO_2$ reducing properties where tested for some samples of the photocatalytic composite paving structure of the invention, comprising a surface layer with a base of cement compositions, as described in Examples 1 and 2.

Instrumentation

Figure 2:
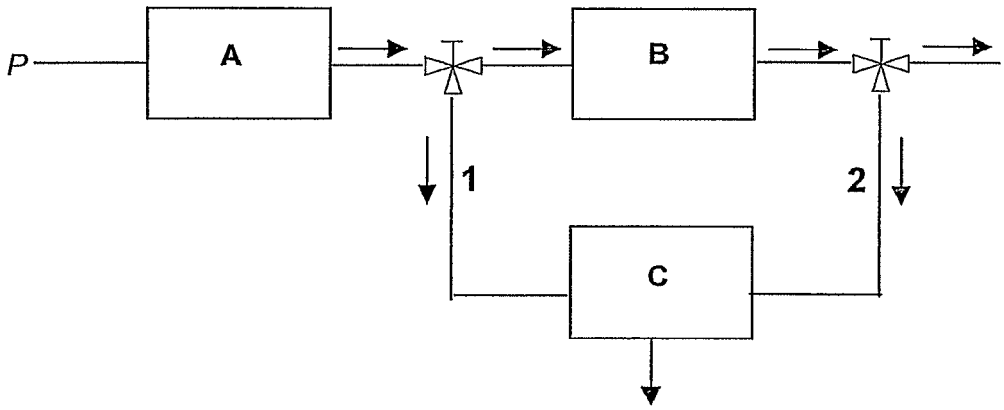
FIG. 2: Graphic representation of scheme 1, as described in Example 3, in which A is a mixing chamber, B is the reaction chamber, C is the chemiluminescence detector of $NO_x$, P is the entrance of the chamber A, 1 and 2 the paths followed by the gas flow.

The analysis of $NO_x$ and of $NO_2$ salts is carried out with a Monitor Labs Model 8440E instrument which works on the principle of chemiluminescence detection. The instrument has four sensitivity intervals: from 0.2 to 5 ppm (parts per million); from 0.1 to 10 ppm; from 0.05 to 5 ppm; from 0.2 to 10 ppm; depending on the selected sensitivity intervals, the instrument precision is 4 ppb (parts per billion) out of 100 ppb or 2.5 ppb out of 400 ppb Experimental Set Up In the following scheme I, as illustrated in FIG. 2, the method for measuring the degree of reduction of $NO_x$ and $NO_2$ by photocatalytic action is described.

Scheme I

A—is a mixing chamber where a mixture of $NO/NO_2$ or of $NO_2$ salts is diluted in air to give the established quantity of pollutants. The experimental procedure adopted contemplates the use of small cylinders (2-5 L) containing pure NO and $NO_2$ which are used to fill a vacuum line with pure gas chamber. From this line, the quantities of gas to be diluted in air through the entry P of the chamber, are taken by means of sampling vials.

B—is the reaction chamber (1.5 L or 3.5 L) containing the photocatalyst sample, the experimental details of which are illustrated in FIG. 1.

C—is the chemiluminescence detector of NOx described above.

The set-up illustrated in scheme I can work both in conditions of continuous flow and with gas recirculation. The first case in illustrated in scheme I: if the gas flow follows path 1, the quantity of $NO_x$ can be measured at the entry of the reactor; instead, through path 2, it is possible to measure the quantity of $NO_x$ at output after the gas has come in contact with the catalyst, both in the dark and under radiation.

Preparation of the Composite Paving Structure

To optimise the bond between the layer of foundation paving of a bituminous nature (asphalt), the epoxy resin and the surface layer of cement mortar having a photocatalytic activity, the surface of the foundation paving was adequately prepared, following the indications given in the literature.

For this purpose surface milling was carried out, removing a thickness of about 2 mm. The limited dimensions of the test area (length 10 m and width 5 m) allowed the use of a manual milling machine.

At a distance of 50 cm from the shortest sides of the test area, two strips with dimensions 5×0.50 m were created, removing a layer of 4-5 cm from the paving.

The aim of this operation was to create a connection between the bituminous mix and the asphalt test area subsequently coated with the cement mortar.

The milled surface was cleaned with brushes to remove the largest particles produced by milling. The finest particles were removed using compressed air; lastly the surface was washed with a jet of water.

A mesh of stainless steel having a link opening of 25 mm and a wire diameter of 1 mm was then fixed with a nail gun.

An epoxy composition based on an epoxy resin Bakelite EPR 05335 with a hardener type EPH 04852 (manufacturer Bakelite AG) was sprayed homogeneously onto the mesh and onto the milled foundation. The primer consumption was about 280 $g/m^2$ On the asphalt surface thus treated, in different zones, photocatalytic cement mortars of compositions as indicated in Examples 1 and 2 were applied with a roller, with different thickness values between 10 and 20 mm. Before application, each composition was mixed energetically for five minutes with a high speed agitator, until a fluid consistency was obtained. The samples of photocatalytic cement mortar/asphalt paving thus realised were then cured for seven hours at 20° C.±2° C. and RH about 60±5%.

A. $NO_x$ Reduction Test

Specimens with a surface 10 cm×10 cm were bored from the cement mortar/asphalt paving when the photocatalytic cement mortar, forming the surface layer, was completely hardened. The test surface of each specimen was inspected with an optic microscope to exclude the presence of cracks that could affect the quality of the analysis of photocatalytic efficiency. The degree of $NO_x$ reduction, using the configuration of path 1 described in the experimental set-up, was assessed as follows:

$NO_x$ degree of reduction (%)=($NO_x$ concentration at input−$NO_x$ concentration at output)/$NO_x$ concentration at input×100

The results are shown in table 1.

TABLE 1

| Cement mortar Example | Degree of reduction of $NO_x$ (%) |
|---|---|
| 1 | 88 |
| 1 | 85 |
| 2 | 87 |
| 2 | 89 |

($NO_x$ concentration at input 1 ppm).

B. $NO_2$ Reduction Test

Specimens prepared as described in the reduction test A were tested for the reduction of $NO_2$, proceeding as in A. The data of the degree of $NO_2$ reduction, calculated as in test A., are shown in Table 2.

TABLE 2

| Cement mortar Example | Degree of reduction of $NO_2$ (%) |
|---|---|
| 1 | 85 |
| 2 | 86 |

Example 4

Fatigue stress test were performed on a piece of composed paving realised according to the present invention (defined PC1) having layout dimensions 230×50 cm.

The tests were carried out using a mechanical vibrator able to generate a cyclic load having an amplitude varying over time according to a sinusoidal law. The vibrator was firmly anchored in the centre line of a steel frame having two support bases at about 200 cm from each other and each having an imprint on the ground of 10×20 cm. The imprint of the bases of the frame and their centre distance were realised inn such a way as to simulate the imprint on the ground of two wheels of an average car (front wheel and rear wheel). The application of the load using the frame described above allows simulation of the stress exerted on the paving by the passage of a car.

The fatigue stress was carried out as follows:

| Phase | Type of excitation | Interval of applied stress [kg/cm$^2$] | Frequency [Hz] | Number of cycles |
|---|---|---|---|---|
| 1 | Vertical | +0.04/+2.8 | 14 | 2 000 000 |
| 2 | Horizontal | +0.13/−0.13 | 9 | 275 000 |
| 3 | Vertical | +0.04/+2.8 | 14 | 2 000 000 |
| 4 | Horizontal | +0.13/−0.13 | 9 | 275 000 |

As a precautionary measure, the maximum stress applied in the case of vertical excitation was set at a value higher than that induced by an average car, which amounts to about 2 kg/cm$^2$.

During the performance of the fatigue tests the vibrations generated by the applied dynamic excitation are measured with seismometric triads able to measure accelerations in three directions at right angles to each other (vertical, longitudinal, transverse) and arranged as specified below:

- 2 seismometric triads on the composite paving near the support bases of the frame (S1 and S3);
- 2 seismometric triads as reference, corresponding to the previous two but laid on the pre-existing asphalt (S2 and S4).

The analysis of the signals found by the four seismometric triads did not show any sign of decay of the tested composite paving. In particular, FIGS. 3*a* and 3*b* show, respectively for the phases 1 and 3, the vertical signal of the seismometric triads on the tested paving (S1V and S3V) related to the signal obtained from the reference seismometric triads (S2V and S4V).

Figure 3A:
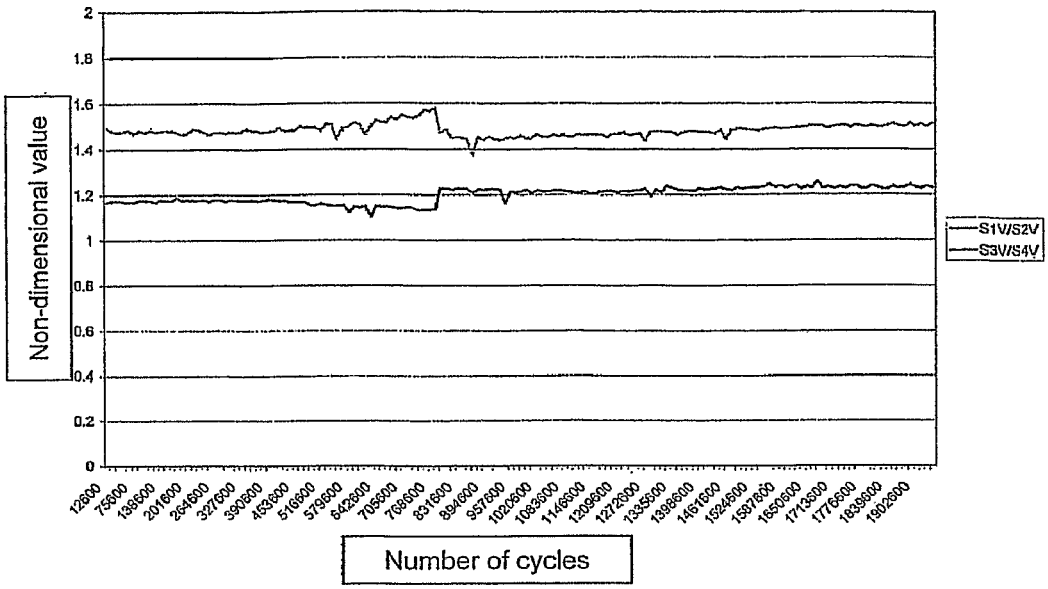
FIG. 3*a*—Ratio between the signals of the seismometric triads found during phase 1.
Figure 3B:
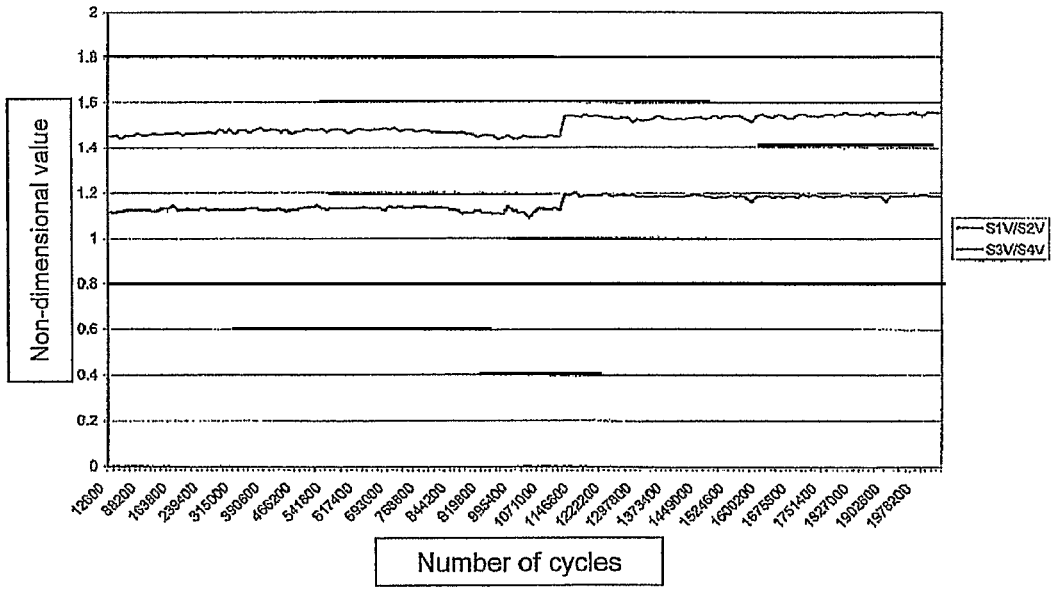
FIG. 3*b*—Ratio between the signals of the seismometric triads found during phase 3.

The analysis of the graphs in FIGS. 3*a* and 3*b* shows that during the test phases there is no sign of abnormal behaviour that could be attributed to decay. The variation of the ratio that can be observed corresponding to a number of cycles of about 800,000 for phase 1 and about 1,100,000 for phase 3 is not of a significantly high extent and anyway its cyclic nature is compatible with variations in response induced by daily temperature cycles.

Figure 4A:
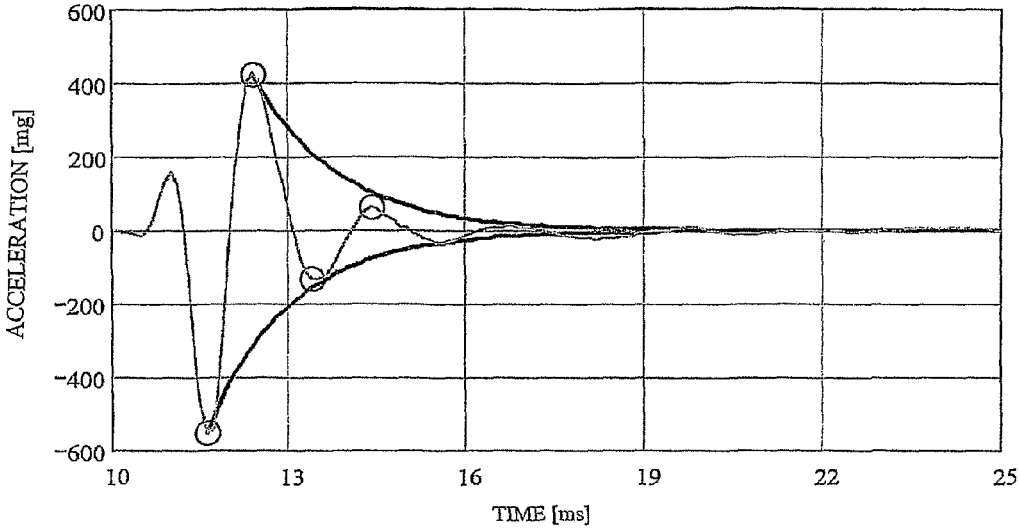
FIG. 4*a*—Accelerometric signal found on the paving PC1 after impulse excitation with indication of the bottom and top envelope contours. Damping index $\xi$=18.

On the same paving tests were also carried out to check the adhesion between the top layer of cement mortar and the pre-existing bituminous paving. These tests were carried out by measuring and analysing the vertical accelerations on the cement surface induced by an impulse stress applied with a hammer. The test was carried out on a grid of points involving the whole surface of the paving. As an example, FIG. 4*a* shows the signal measured in a point of the paving.

The analysis of the top and bottom envelope contours of the signal allows the determination of the damping value ξ which may be assumed as an index of the adhesion of the top layer to the pre-existing foundation. A high damping value, signalled by a rapid approach of the envelope contours to the horizontal axis, indicates good adhesion, unlike the case in which the envelope contours get gradually closer to the horizontal axis.

The damping of the signals examined may be assessed by means of the damping index ξ; values of ξ higher than 15 are to be considered indicative of good adhesion. In the specific case of the signal in FIG. 4*a* the ξ index is 18 and, in any case, for the paving examined, values of ξ always higher than 15 have been found.

Example 4*b* (Reference)

Figure 4B:
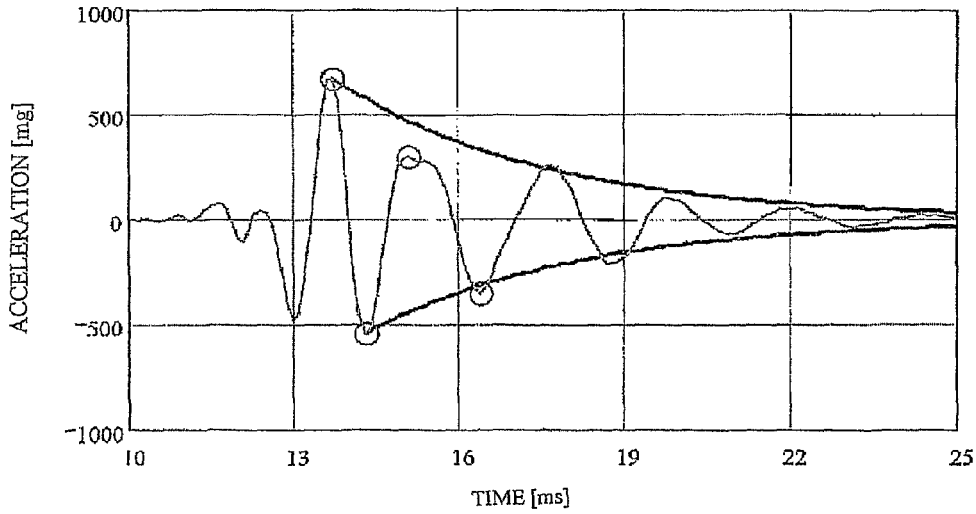
FIG. 4*b*—Accelerometric signal found on the paving PC2 (for comparison) after impulse excitation with indication of the bottom and top envelope contours $\xi$=5.

On a piece of composed paving realised according to the present invention, but without the necessary adhesion between the top layer of cement mortar and the pre-existing bituminous paving (defined PC2), tests were performed according to the procedure described in example 2. The piece of composite paving had dimensions 380×1200 cm. The lack of adhesion is shown by the values of the damping index ξ which are generally lower than 15; for example, at one of the support bases of the frame used for the test it was 5 (FIG. 4*b*).

The fatigue stress was carried out as follows:

| Phase | Type of excitation | Interval of applied stress [kg/cm$^2$] | Frequency [Hz] | Number of cycles |
|---|---|---|---|---|
| 1 | Vertical | +0.04/+2.8 | 14 | 100 000 |
| 2 | Vertical | +0.04/+2.8 | 14 | 2 000 000 |
| 3 | Horizontal | +0.13/−0.13 | 9 | 260 000 |
| 4 | Vertical | +0.04/+2.8 | 14 | 2 000 000 |

The dimensions of the paving PC2 did not allow the use of reference seismometric triads placed on the bituminous paving. The acceleration data found are therefore difficult to interpret, however visual analyses were carried out of the picture of cracking of the paving PC2. A few days after casting of the surface layer of cement mortar, cracks appeared due to shrinkage in a direction at a right angle to the longitudinal axis of the same paving. Following the stresses induced during the test, near one of the support bases of the test frame, one of the shrinkage cracks showed a clear increase in opening, as illustrated in FIG. 5.

Figure 5:
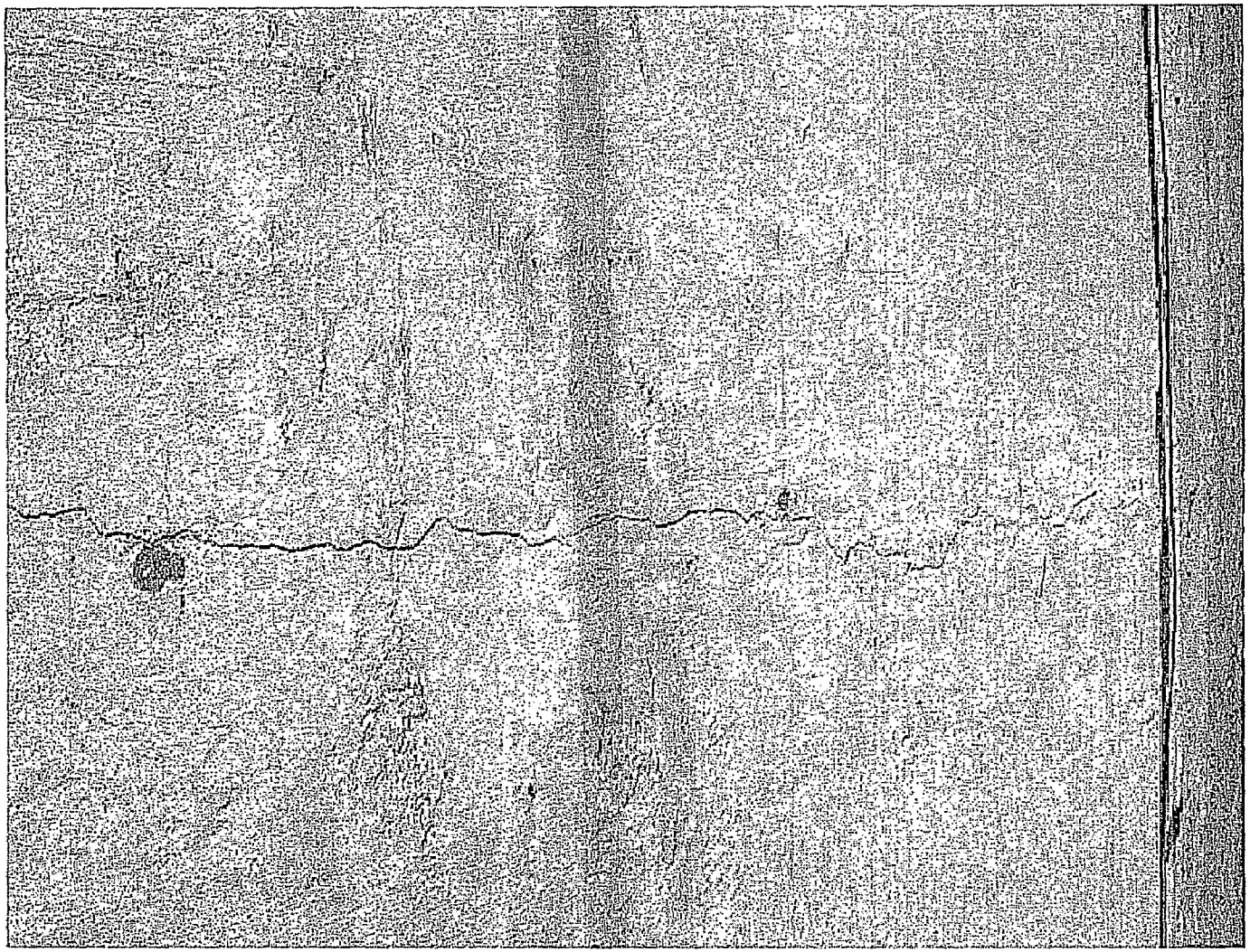
FIG. 5—Opening of a crack in the paving PC2 after phase 4 of the fatigue test.

With all probability, the state of the crack illustrated in FIG. 5 is the result of the overlapping of two concurrent causes: cyclic mechanical stress and thermal deformations. In any case the lack of the necessary adhesion between the top layer of cement mortar and the pre-existing bituminous paving allowed the considerable increase of the initial opening of the shrinkage crack in the layer of cement mortar.

The invention claimed is:

1. A composite paving with photocatalytic action able to decompose urban polluting agents consisting of, from bottom to top:

(i) a bituminous foundation layer; and (iii) a surface layer comprising a photocatalytic cement composition wherein an intermediate layer (ii) made of a resin laid onto a mesh or onto a set of independent and overlaid filaments or fibers is inserted between (i) and (iii).

2. Paving according to claim 1, wherein said layer (iii) presents a thickness between 5 mm and 50 mm.

3. Paving according to claim 1, wherein said layer (iii) presents a thickness between 10 mm and 30 mm.

4. Paving according to claim 1, wherein said foundation layer is a surface of urban or extra-urban paving, pre-existing or newly formed.

5. Paving according to claim 1, wherein the resin is chosen among epoxy and polyurethane resins.

6. Paving according to claim 1, wherein said mesh or set of independent and overlaid filaments of fibers are made of steel.

7. Paving according to claim 1, wherein the layer (iii) contains the photocatalyst in a concentration between 0.1 and 20% by weight with respect to the total of the components of the layer (iii) in the dry state.

8. Paving according to claim 1, wherein the cement contained in the layer (iii) is a quick setting cement.

9. Paving according to claim 1, wherein the layer (iii) includes fibrous material.

10. Paving according to claim 9, wherein the fibrous material is composed of polypropylene fibres with length between 3 and 25 mm.

11. Method for preparing the paving described in claim 1, comprising the following steps:

(a) applying the resin laid onto the mesh or onto the set of independent and overlaid filaments or fibers on the foundation layer (b) applying on the resulting layer a fresh cement composition comprising a photocatalyst.

12. Method according to claim 11, wherein the foundation layer is a pre-existing layer or a newly formed layer.

13. Method according to claim 11, wherein the resin is chosen among epoxy and polyurethane.

14. Method according to claim 11, wherein the resin is applied in quantities between 50 and 600 gr/m$^2$.

15. Method according to claim 11, wherein the fresh cement composition applied in passage (b) has a water/binder ratio between 0.3 and 0.45, and contains between 30 and 45% in weight of binder with respect to the total of the solid components of the composition.

16. Method to reduce the organic and inorganic pollutants present in the environment characterised by laying in said environment the composite paving described in claim 1.

17. Method according to claim 16, wherein said pollutants are one or more selected from the group consisting of aromatic polycondensates, aldehydes, carbon black which may be assimilated to PM10, nitrogen oxides ($NO_x$) and sulphur oxides ($SO_x$).

18. Method according to claim 11, wherein the resin is applied in quantities between 100 and 300 gr/m$^2$.

* * * * *